United States Patent [19]

Ray

[11] 4,290,808

[45] Sep. 22, 1981

[54] METALLIC GLASS POWDERS FROM GLASSY ALLOYS

[75] Inventor: Ranjan Ray, Randolph, N.J.

[73] Assignee: Allied Chemical Corporation, Morris Township, Morris County, N.J.

[21] Appl. No.: 23,411

[22] Filed: Mar. 23, 1979

[51] Int. Cl.[3] ..... B22F 9/04; B22F 9/06

[52] U.S. Cl. ..... 75/251; 75/0.5 BA; 241/23

[58] Field of Search ..... 78/251; 241/23; 75/252–255, 0.5 BA, 0.5 AA, 0.5 R; 428/900; 360/125, 126, 131–136; 29/603; 427/128–138; 148/104, 105

[56] References Cited

U.S. PATENT DOCUMENTS

| | | | |
|---|---|---|---|
| 3,790,407 | 2/1974 | Merten et al. | 427/130 |
| 3,856,513 | 12/1974 | Chen et al. | 75/123 D |
| 3,970,254 | 7/1976 | Marsh | 241/23 |
| 4,063,942 | 12/1977 | Lundgren | 75/251 |
| 4,069,045 | 1/1978 | Lundgren | 75/251 |
| 4,072,781 | 2/1978 | Shirahata et al. | 360/131 |
| 4,079,430 | 3/1978 | Fujishima et al. | 360/126 |
| 4,101,311 | 7/1978 | Aonuma et al. | 75/0.5 AA |
| 4,158,582 | 6/1979 | Krause | 148/105 |
| 4,197,146 | 4/1980 | Frischmann | 148/31.55 |

FOREIGN PATENT DOCUMENTS 2126687 12/1972 Fed. Rep. of Germany ..... 148/105

OTHER PUBLICATIONS

Roberson, H. A., "Up In the Air About Metal Tape", *Audio,* Sep. 1979, pp. 50–57.

Boswell, P. G. et al., "The Formation and Crystallization of an Amorphous Phase in an Iron–Carbon Alloy", J. of Materials Science, vol. 11, pp. 2287–2296 (1976).

Rayment, J. et al., "Splat–Quenched Tungsten Stells," *Rapidly Quenched Metals III,* The Metals Society, London, pp. 85–93 (1978).

Livingstone, W., "Bulletin", *Stereo Review* , Oct., 1979, p. 5.

Barnhart, C. L., *The American College Dictionary,* Random House, New York, pp. 372, 835 (1970).

*Primary Examiner*—Michael L. Lewis

*Attorney, Agent, or Firm*—Gerhard H. Fuchs; Michael J. Weins

[57] ABSTRACT

Metallic glass powder is prepared by heating a solid metallic glass body to a temperature below its glass transition temperature for time sufficient to effect embrittlement, followed by comminution of the embrittled metallic glass body.

4 Claims, No Drawings

METALLIC GLASS POWDERS FROM GLASSY ALLOYS

DESCRIPTION

1. Field of the Invention

The invention relates to amorphous metal powders and in particular to amorphous metal powders having the composition of known glass forming alloys.

2. Description of the Prior Art

Metallic glasses (amorphous metals), including metallic glasses in powder form have been disclosed by Chen et al. in U.S. Pat. No. 3,856,513. They prepared amorphous alloy powders by flash evaporation. They further disclose that powders of amorphous metal having the particle size ranging from about 0.0004 to 0.01 inch can be made by atomizing the molten alloy to droplets of this size and then quenching the droplets in a liquid such as water, refrigerated brine or liquid nitrogen.

A method for making metal flakes suitable for making metal powder for powder metallurgical purposes is disclosed by Lundgren in German Offenlegungsschrift No. 2,553,131 published Aug. 12, 1976. The process involves impinging a jet thin, brittle and easily shattered, essentially dentrite free metal flakes are obtained with between amorphous and microcrystalline structure, from which a metal powder can be obtained by shattering and grinding, for instance in a ball mill.

There remains a need for methods for making amorphous (glassy) metal powder having good properties for use in metallurgical processes.

SUMMARY OF THE INVENTION

In accordance with the invention a method of producing metallic glass powder is provided wherein a solid metallic glass body usually in filamentary form is heated at a temperature within the range from about 250° C. below its glass transition temperature and up to its glass transition temperature for time sufficient to effect embrittlement without causing formation of a crystalline phase. The embrittled metallic glass body is comminuted to powder.

DETAILED DESCRIPTION OF THE INVENTION

Metallic glass alloy powders are prepared according to a process involving first annealing a glassy alloy to an embrittled state and then comminuting the embrittled alloy to a powder. Glassy alloys suitable for use in the invention process are known products and are disclosed for instance, in Chen and Polk U.S. Pat. No. 3,856,553 issued Dec. 24, 1974. These alloys can be rapidly quenched from the melt by known procedures to obtain splats or filament (e.g. sheets, ribbons, tapes, wires, etc.) of amorphous metal. These metallic glasses in sheet, ribbon, tape, splat and wire form can be annealed at a temperature below the glass transition temperature to effect embrittlement.

Heating the metallic glass body to effect embrittlement can be carried out in a suitable annealing furnace. Such annealing furnaces can be divided into furnaces which operate by a batch process and those operating continuously, and either may be electrically heated or fuel fired. Gas heated crucible or box furnaces are suitable, but the glassy metal charge should be protected from the furnace gases by a gas-tight crucible or retort. Electric furnaces with Nichrome or Kanthal resistor elements can be used for temperatures up to 1050° C.

which is high enough for embrittlement of most metallic glasses. Tightly sealed boxes or retorts in which the glassy material is surrounded by inert packs or protective atmospheres can be heated in bell-type or box-type furnaces. Electric muffle furnaces also require a retort if heated by a Nichrome or Kanthal wire spiral wound on the refractory muffle. Electric box and muffle furnaces may also be heated by silicon carbide heating elements. Since these elements burn in air, no gas-tight housing is necessary, but the charge must be contained in a closed retort or box to retain the protective atmosphere or pack.

Continuous furnaces are generally more efficient for the production of embrittled metallic glases. Several suitable types of horizontal continuous furnaces can be used. One type is the pusher type which is frequently used with metallic or refractory muffles. The furnace can be heated by gas or electricity, and the metallic glass to be embrittled is placed in rigid trays of cast or fabricated alloy, or of graphite. Either mechanical or hydraulic pusher systems may be used, and the push may be either gradual or sudden.

Problems connected with transport of trays containing material to be annealed through the furnace can be reduced considerably if friction of the moving trays is eliminated through the incorporation of rolls in the muffle bed or if a mesh belt conveyor furnace is employed. High capacity roller hearth furnaces have rolls in the heating and cooling zones and permit flexible transport of light weight trays by individual driving mechanisms. Internal gates may subdivide entrance and cooling chambers from the hot zone and prevent the entering of unwanted gases during the operation. Although the glassy metal must travel through the entire mesh belt conveyor furnace at the same speed, rapid heating of the glass is possible by proper distribution of the heat input. If the furnace is divided into several zones, a large part of the heat can be furnished in the first zone and then stored by the heat capacity of the metallic glass. The charge can be placed directly on the conveyor, or can be contained in light weight trays provided with shields to eliminate excessive side radiation from the heating elements.

Vertical continuous furnaces are also suitable and may be coupled with a cooling chamber. The metallic glass in filamentary forms is lowered either in continuous form or in crucible containers through the furnace and cooling chamber if one is provided, by means of power driven feeding rolls. Rotation of the metallic glass filament at the same time allows a very uniform heat distribution over the metallic glass. The capacity of a vertical furnace is frequently less than that of other types, but larger furnaces for embrittling of up to one ton of metallic glass can be provided. The vertical furnace is especially suitable for the embrittlement of continuous metallic glass filaments.

Whether the metallic glass body has acquired a sufficient degree of brittleness can be tested by bending procedures. Depending upon the thickness of the ribbon employed initially a suitable radius can be selected for bending the embrittled ribbon. If the ribbon fails when bent around an adequately sized radius, the embrittlement process has been carried far enough. The larger the radius of breaking, the better embrittled the material. For ease of subsequent comminution, materials embrittled according to the present invention should fail when bent around a radius of about 0.1 cm and preferably of about 0.5 cm.

The annealing temperature may be within the range of from 250° C. below the gas transition temperature and up to the glass transition temperature, and preferably is within the range of from 150° C. below the glass transition temperature to 50° C. below the glass transition temperature. Lower embrittling temperatures require longer embrittling times than higher embrittling temperatures for achieving comparable degrees of embrittlement. The annealing time therefore varies depending on temperature, and may range from about 1 minute to 100 hours, and is preferably from about 10 minutes to 10 hours.

In case support means for the ribbon to be embrittled are needed, they are made from materials which do not react with the alloy even at the highest annealing temperatures employed. Such materials include alumina, zirconia, magnesia, silica and mixed salts thereof; boron nitride, graphite, tungsten, molybdenum, tantalum, silicon carbide, and the like.

The atmosphere employed for annealing process depends on the specific alloy composition to be annealed. Numerous metallic glasses can be anneal embrittled in air without being significantly oxidized, and these are preferably embrittled in air for the sake of convenience. Vacuum or inert annealing atmospheres can be provided for those alloys which tend to oxidize under anneal embrittlement conditions. Generally, inert atmospheres such as provided by gases like argon, helium, neon and nitrogen, are suitable. Reducing atmospheres can be employed to prevent oxidation of the metallic alloy while being annealed. In case a reducing atmosphere is desired, then hydrogen, ammonia, carbon monoxide and the like are preferred. In case of alloys having a metalloid component it may be advantageous to establish a partial pressure of that metalloid in the annealing atmosphere, e.g. for phosphide metallic glasses an atmosphere having a partial pressure of phosphorus as provided by phosphine in the atmosphere may be preferred.

In addition, it is possible to integrate the process of casting of a glassy alloy and of embrittling it. This can be done by casting of ribbons on a rotating chill substrate and by reducing the residence time of the ribbon on the substrate, so that the ribbon is made to depart the substrate when cooled just below the glass transition temperature [$T_g$], and then slowly cooling it below the glass transition temperature out of contact with the chill substrate for thereby anneal embrittling it. Such embrittled ribbons can be comminuted in completely analogous fashion to form flake or powder as desired of any desired particle size and particle size distribution.

After the glassy material is embrittled, it is relatively easy to comminute same to flake or fine powder, as desired.

Milling equipment suitable for comminution of the embrittled metallic glass includes rod mills, ball mills, impact mills, disc mills, stamps, crushers, rolls and the like. To minimize contamination of the powder, the wearing parts of such equipment are desirably provided with hard and durable facings. Undue heating and ductilization of the powder may be prevented by water cooling of the grinding surfaces. If desired, the comminution process may be performed under a protective atmosphere or in vacuum to prevent air from affecting the powder. Protective atmospheres can be inert, such as provided by nitrogen, helium, argon, neon and the like, or reducing such as provided by hydrogen.

One type of mill suitable for the comminution of embrittled metallic glass powders is the conventional hammer mill having impact hammers pivotably mounted on a rotating disc. Disintegration of the metallic glass is effected by the large impact forces created by the very high velocity of the rotating disc. Another example of a suitable type of mill is the fluid energy mill.

Ball mills are preferred for use in the comminuting step inter alia because the resilient product has relatively close particle size distribution.

Following comminution the powder may be screened, for instance, through a 100 mesh screen, if desired, to remove oversize particles. The powder can be further separated into desired particle size fractions; for example, into 325 mesh powder and powder of particle size between 100 mesh and 325 mesh. The weight distribution of the particle size fractions of anneal embrittled, ball milled glassy alloy powder $Fe_{65}Mo_{15}B_{20}$ (atomic percent) was determined for different ball milling times. After milling for ½ hour the average particle size was about 100 micron. After milling for 2 hours the average particle size was reduced to about 80 micron. The sample size employed was 100 grams of material. The diameter of the mill vessel was 10 cm and the length of the mill was 20 cm. The inner surface of the vessel consisted of high density alumina and the ball mill was rotated at 60 R.P.M. The balls in the mill were made of high density alumina and had a diameter of 1.25 cm.

The powder prepared according to the present invention in general does not exhibit sharp edges with notches as typically found in glassy metallic powders prepared according to the process involving chill casting of an atomized liquid as disclosed in my commonly assigned copending applications Ser. No. 023,413 filed Mar. 23, 1979 and Ser. No. 023,412 filed Mar. 23, 1979, filed of even date herewith. A particular advantage of a powder with less rough edges is that the particles can slide against each other and as a result can be compacted to higher density at equivalent pressure compared with an analogous chill cast atomized alloy. A compact of higher density is often a more desirable starting material for powder metallurgical applications. The metallic glass powder of the present invention is useful for powder metallurgical applications.

A metallic glass is an alloy product of fusion which has been cooled to a rigid condition without crystallization. Such metallic glasses in general have at least some of the following properties: high hardness and resistance to scratching, great smoothness of a glassy surface, dimensional and shape stability, mechanical stiffness, strength and ductility and a relatively high electrical resistance compared with related metals and alloys and a diffuse X-ray diffraction pattern. Powder of metallic glass made according to the invention process may comprise fine powder with particle size under 100 micron, coarse powder with particle size between 100 micron and 1000 micron and flake with particle size between 1000 and 5000 micron, as well as particles of any other desirable particle size, as well as particle size distribution, without limitation. Alloys suitable for use in the invention process disclosed in the invention include those known in the art for the preparation for metallic glasses, such as those disclosed in U.S. Pat. Nos. 3,856,513; 3,981,722; 3,986,867; 3,989,517 as well as many others. For example, Chen and Polk in U.S. Pat.

No. 3,856,513 disclose alloys of the composition $M_aY_bZ_c$, where M is one of the metals, iron, nickel, cobalt, chromium and vanadium; Y is one of the metalloids, phosphorus, boron and carbon; and Z equals aluminum, silicon, tin, germanium, indium, antimony or beryllium with "a" equaling 60 to 90 atom percent, "b" equaling 10 to 30 atom percent and "c" equaling 0.1 to 15 atom percent with the proviso that the sum of a, b and c equals 100 atom percent. Preferred alloys in this range comprises those where "a" lies in the range of 75 to 80 atom percent, "b" in the range of 9 to 22 atom percent, "c" in the range of 1 to 3 atom percent. Furthermore, they disclose alloys with the formula $T_iX_j$ wherein T is a transition metal and X is one of the elements of the groups consisting of phosphorus, boron, carbon, aluminum silicon, tin, germanium, indium, beryllium and antimony and wherein "i" ranges between 70 and 87 atom percent and "j" ranges between 13 and 30 atom percent. However, it is pointed out that not every alloy in this range would form a glassy metal alloy.

The examples set forth below further illustrate the present invention and set forth the best mode presently contemplated for its practice.

EXAMPLE 1

A metallic glass in the form of ribbon of composition $Fe_{40}Ni_{40}P_{14}B_6$ (atom percent) having a glass transition temperature of 400° C. was annealed at 250° C. for 1 hour. The annealing atmosphere was argon. X-ray diffraction analysis showed that the annealed ribbon remained fully glassy. The resulting ribbon was brittle, and was ground in a ball mill under high purity argon atmosphere for 1.5 hours. The ball mill vessel was made of aluminum oxide and the balls were high density aluminum oxide. The resulting particles had a size of between about 25 and 100 microns. X-ray diffraction analysis and differential scanning calorimetry revealed that the powder was fully glassy.

EXAMPLES 2-8

Metallic glass in ribbon form of composition indicated in Table 1 was annealed in high purity argon atmosphere at temperatures and for times given to effect embrittlement. X-ray diffraction analysis showed that the annealed ribbon remained fully amorphous. The embrittled ribbon was ground in a ball mill under high purity argon atmosphere for the time indicated in the table. The ball mill vessel was made of alumina oxide and the balls were made of high density alumina oxide. The resultant ball milled powder had a fine particle size between about 25 and 125 microns, as given in the table, and the powders were found to be noncrystalline by X-ray analysis and differential scanning calorimetry.

EXAMPLE 9

Nickel, cobalt and iron base metallic glass alloys containing chromium and molybdenum can be fabricated by powder metallurgical techniques into structural parts with excellent properties desirable for wear and corrosion resistant applications. Such materials will find uses in pumps, extruders, mixers, compressors, valves, bearings and seals especially in the chemical industry.

Metallic glass powders having the composition (atom percent) $Ni_{60}Cr_{20}B_{20}$, $Fe_{65}Cr_{15}B_{20}$, $Ni_{50}Mo_{30}B_{20}$ and $Co_{50}Mo_{30}B_{20}$ were hot pressed in vacuum of $10^{-2}$ Torr for ½ hour under 4000 psi between 800° and 950° C. into cylindrical compacts. The cylindrical compacts containing crystalline phases up to 100 percent had hardness values ranging between 1150 and 1400 kg/mm$^2$. The above compacts were kept immersed in a solution of 5 wt% NaCl in water at room temperature for 720 hours. The samples exhibited no traces of corrosion.

TABLE I

| Example | Composition (atom percent) | Thickness | Annealing Temperature [°C.] | Annealing Time [h] | Milling Time [h] | Milled Powder Size [micron] |
|---|---|---|---|---|---|---|
| 2 | $Fe_{65}Cr_{15}B_{20}$ | 0.0015" | 300 | 1.5 | 2 | 50-125 |
| 3 | $Fe_{50}Ni_{20}Mo_{10}B_{20}$ | 0.0015" | 350 | 2 | | 75-125 |
| 4 | $Ni_{45}Co_{20}Cr_{10}Fe_5Mo_4B_{16}$ | | 400 | 1 | 6 | 30-100 |
| 5 | $Fe_{45}Ni_{10}Co_7Mo_{10}Cr_8B_{20}$ | | 350 | 1.5 | 3 | 75-125 |
| 6 | $Fe_{80}B_{20}$ | | 300 | 2 | 6 | 75-125 |
| 7 | $Fe_{40}Ni_{40}B_{20}$ | 0.0015" | 350 | 2 | 4 | 75-125 |
| 8 | $Fe_{65}Mo_{15}B_{20}$ | | 400 | 2 | 2 | 25-100 |

I claim:

1. Metallic glass powder having particle size of less than 4 mesh (U.S. Standard) comprising platelets having thickness of less than 0.1 millimeter, each platelet being of substantially uniform thickness throughout, and each platelet being defined by an irregularly shaped outline resultant from fracture of a substantially uniform thickness rapidly solidified embrittled amorphous material.

2. The metallic glass powder of claim 1 having particle size of less than 10 mesh (U.S. Standard).

3. The metallic glass powder of claim 1 wherein said platelets have a substantially uniform thickness throughout of between about 0.02 and about 0.075 millimeter.

4. The metallic glass powder of claim 3 having particle size of less than about 10 mesh (U.S. Standard).

* * * * *